US009924851B2

(12) United States Patent
Kulkarni

(10) Patent No.: US 9,924,851 B2
(45) Date of Patent: Mar. 27, 2018

(54) MODULAR DISHWASHER RACK SYSTEM

(71) Applicant: General Electric Company, Schenectady, NY (US)

(72) Inventor: Ashutosh Kulkarni, Bangalore (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 135 days.

(21) Appl. No.: 15/019,992

(22) Filed: Feb. 10, 2016

(65) Prior Publication Data

US 2017/0224189 A1 Aug. 10, 2017

(51) Int. Cl.
*A47L 15/50* (2006.01)
*A47L 15/22* (2006.01)

(52) U.S. Cl.
CPC ..... *A47L 15/501* (2013.01); *A47L 15/22* (2013.01); *A47L 15/50* (2013.01)

(58) Field of Classification Search
CPC ..... A47L 15/501
See application file for complete search history.

(56) References Cited

U.S. PATENT DOCUMENTS 5,462,348 A 10/1995 Ellingson et al.
9,033,432 B2 5/2015 Kilic et al.

FOREIGN PATENT DOCUMENTS

WO WO2013182512 A1 12/2013

*Primary Examiner* — Jason Ko
(74) *Attorney, Agent, or Firm* — Dority & Manning, P.A.

(57) ABSTRACT

A rack assembly for a dishwasher appliance is provided. The rack assembly includes one or more modular baskets placed in a primary rack. These baskets are easily removable and portable for loading and prewashing if desired. In addition, each of the modular baskets may have at least one sidewall that is collapsible. The collapsible sidewalls may be collapsed and adjacent baskets may be linked together using clips as needed based on the size of the dishware to be washed. In this manner, the rack assembly and modular baskets provide a convenient, configurable rack system that enables simple and effective loading, unloading, and prewashing of dishware.

13 Claims, 10 Drawing Sheets

MODULAR DISHWASHER RACK SYSTEM

FIELD OF THE INVENTION

The subject matter of the present disclosure relates generally to dishwasher appliances and more particularly to rack systems for dishwasher appliances.

BACKGROUND OF THE INVENTION

Dishwasher appliances generally include a tub that defines a wash chamber. Rack assemblies can be mounted within the wash chamber of the tub for receipt of articles for washing. Spray assemblies within the wash chamber can apply or direct wash fluid towards articles disposed within the rack assemblies in order to clean such articles. A fluid circulation assembly may include a pump for circulating fluid through the spray assemblies.

Typically, an upper rack and a lower rack of the dishwasher appliance are pulled out of the wash chamber for loading and unloading of dishes. More specifically, upper rack may be attached to the tub by two slide assemblies that allow it to extend from the wash chamber. Lower rack may roll out of the wash chamber on wheels that are rotatably mounted thereto. More specifically, one or more tracks may be defined on the sides of the tub and on the dishwasher door. When the dishwasher door is pivoted into the open, horizontal position, lower rack may be rolled out of the tub onto the open dishwasher door to simplify the loading or unloading process, e.g., by not requiring a user to reach into the wash chamber to add or remove dishes.

Many times, it may be desirable to remove a dishwasher rack from the dishwasher, for example, to perform a prewash cycle on only a particular rack, to soak a particular rack in a kitchen sink prior to running a wash cycle, or to simplify loading and unloading of dishes. However, conventional dishwashers have upper racks that are fixed to the tub and lower racks that are often too bulky or heavy to remove and transport easily. In addition, conventional dishwasher racks do not allow for the removal of only a portion of a rack.

Accordingly, a dishwashing appliance having a rack system that allows for easy removal and transport of the dishwasher racks for loading, unloading, pre wash, or any other purpose would be useful. More particularly, a dishwasher rack system that allows for selective removal of only portions of the dishwasher rack to improve the loading, unloading, and prewashing of dishes would be especially beneficial.

BRIEF DESCRIPTION OF THE INVENTION

The present invention provides a rack assembly for a dishwasher appliance including one or more modular baskets placed in a primary rack. These baskets are easily removable and portable for loading and prewashing if desired. In addition, each of the modular baskets may have at least one sidewall that is collapsible. The collapsible sidewalls may be collapsed and adjacent baskets may be linked together using clips, snaps, or any such engaging devices as needed based on the size of the dishware to be washed. In this manner, the rack assembly and modular baskets provide a convenient, configurable rack system that enables simple and effective loading, unloading, and prewashing of dishware. Additional aspects and advantages of the invention will be set forth in part in the following description, may be apparent from the description, or may be learned through practice of the invention.

In one exemplary embodiment, a dishwasher appliance defining a vertical, a lateral, and a transverse direction is provided. The dishwasher appliance includes a wash tub that defines a wash chamber and a fluid circulation assembly for providing a fluid flow for cleaning articles placed within the wash chamber. A primary rack is slidably positioned within the wash chamber and configured for movement along the transverse direction between a first position where the primary rack is within the wash chamber and a second position where the primary rack is positioned outside the wash chamber. One or more modular baskets are configured to be removably placed in the primary rack for receipt of the articles for washing, each of the modular baskets including a bottom wall and a plurality of sidewalls, at least one of the plurality of sidewalls being collapsible.

In another exemplary embodiment, a rack assembly for a dishwasher appliance defining a wash chamber and a vertical, a lateral, and a transverse direction is provided. The rack assembly includes a primary rack slidably positioned within the wash chamber and configured for movement along the transverse direction between a first position where the primary rack is within the wash chamber and a second position where the primary rack is positioned outside the wash chamber. One or more modular baskets are configured to be removably placed in the primary rack for receipt of the articles for washing, each of the modular baskets comprising a bottom wall and a plurality of sidewalls, at least one of the plurality of sidewalls being collapsible. Each of the primary rack and the modular baskets are formed from coated steel wire oriented to form a lattice structure when clamped together as a group of two or more modular baskets.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
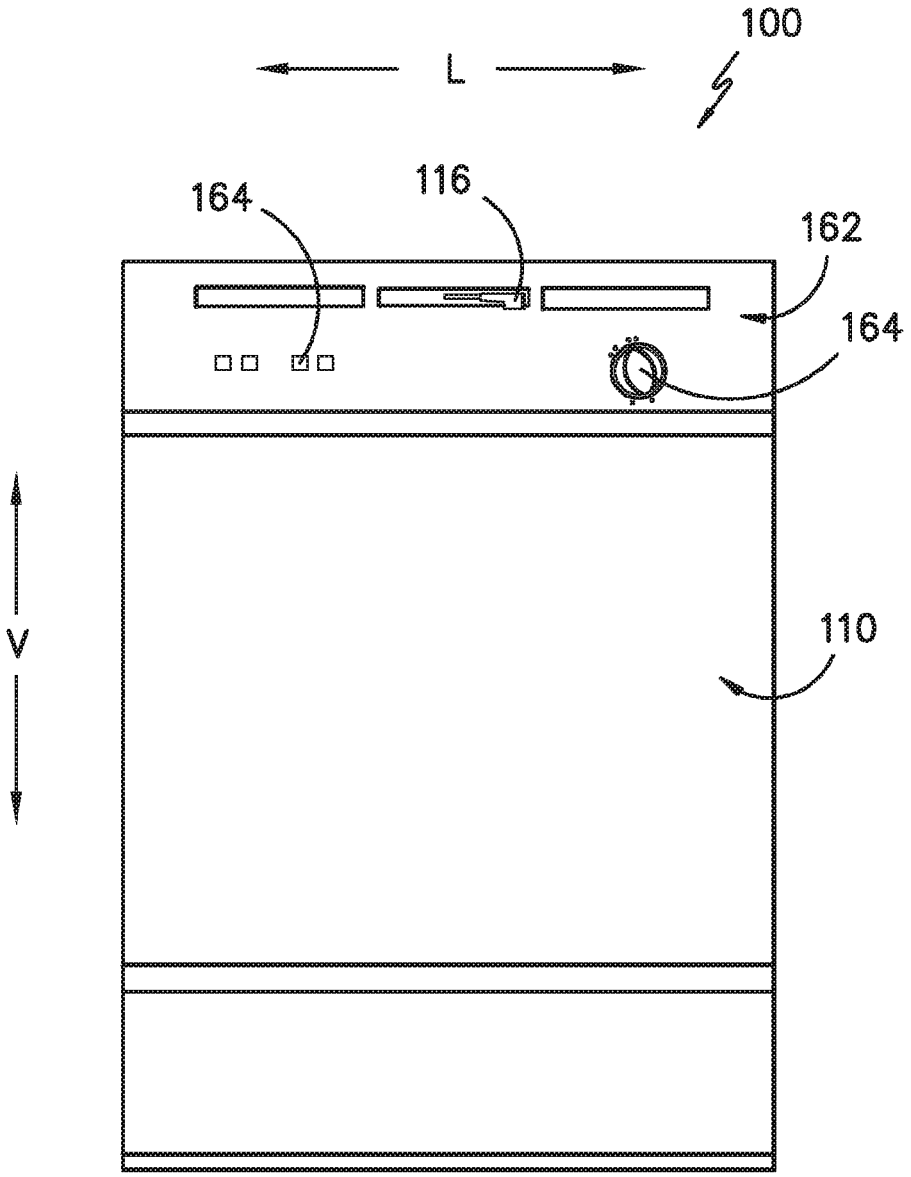
FIG. 1 provides a front view of an exemplary embodiment of a dishwashing appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments. The use of the terms "top" and "bottom," or "upper" and "lower" herein are used for reference only as exemplary embodiments disclosed herein are not limited to the vertical orientation shown nor to any particular configuration shown; other constructions and orientations may also be used.

Figure 2:
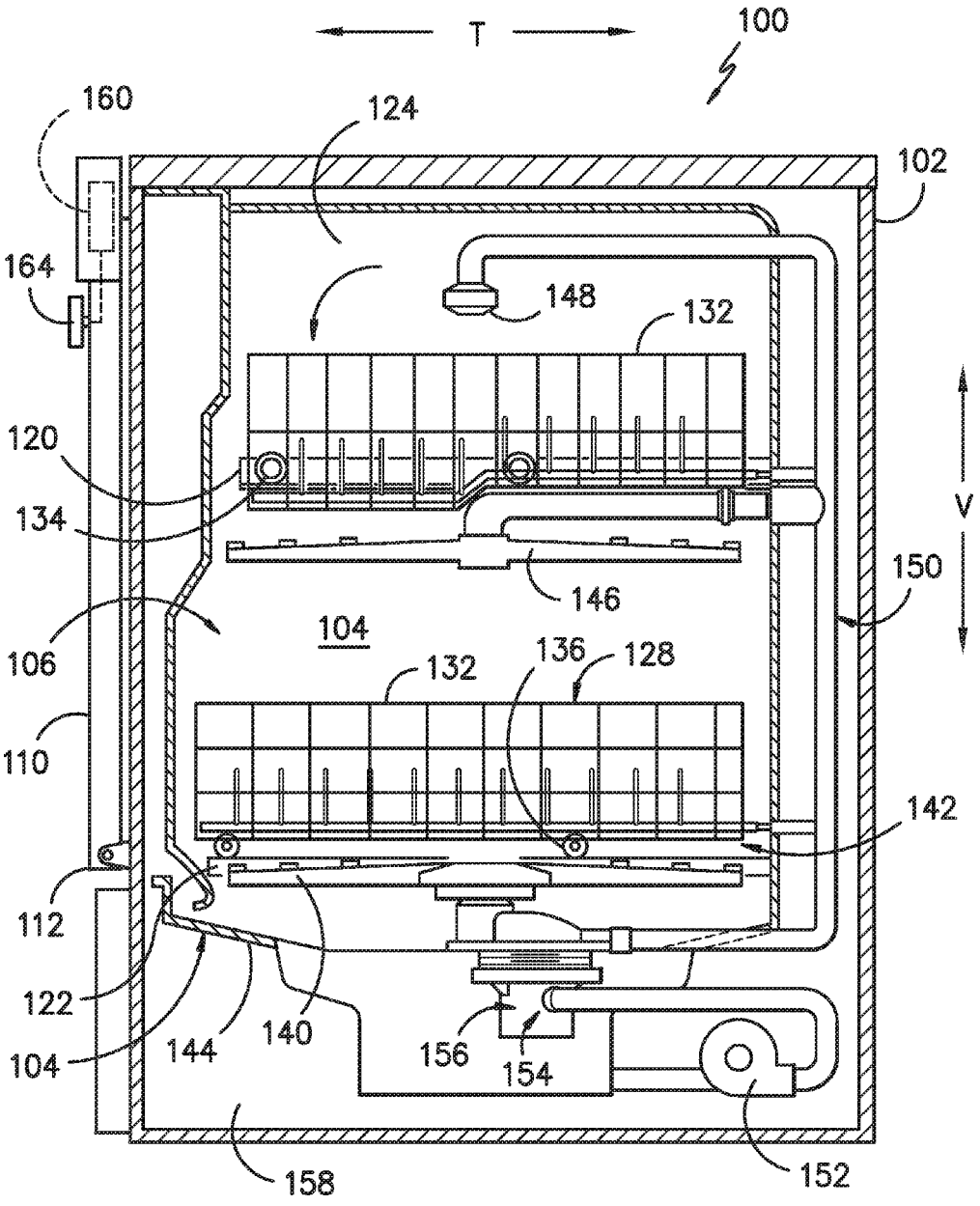
FIG. 2 provides a side cross sectional view of the exemplary dishwashing appliance of FIG. 1.

FIGS. 1 and 2 depict an exemplary domestic dishwasher 100 that may be configured in accordance with aspects of the present disclosure. Dishwasher 100 generally defines a vertical direction V, a lateral direction L, and a transverse direction T, each of which is mutually perpendicular, such that an orthogonal coordinate system is generally defined. For the particular embodiment of FIGS. 1 and 2, the dishwasher 100 includes a cabinet 102 having a tub or inner liner 104 therein that defines a wash chamber 106. The tub 104 includes a front opening (not shown) and a door 110 hinged at its bottom 112 for movement between a normally closed vertical position (shown in FIGS. 1 and 2), wherein the wash chamber 106 is sealed shut for washing operation, and a horizontal open position for loading and unloading of articles from the dishwasher 100. Latch 116 is used to lock and unlock door 110 for access to wash chamber 106.

Upper and lower guide rails 120, 122 are mounted on tub side walls 124 and accommodate roller-equipped upper and lower rack assemblies 126 and 128. Each of the rack assemblies 126, 128 is fabricated into lattice structures including a plurality of elongated members 132 (for clarity of illustration, not all elongated members making up assemblies 126 and 128 are shown in FIG. 2). Each rack 126, 128 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 134 and 136, for example, mounted onto racks 126 and 128, respectively. A silverware basket (not shown) may be removably attached to rack assembly 128 for placement of silverware, utensils, and the like, that are otherwise too small to be accommodated by the racks 126, 128.

The dishwasher 100 further includes a lower spray-arm assembly 140 that is rotatably mounted within a lower region 142 of the wash chamber 106 and above a tub sump portion 144 so as to rotate in relatively close proximity to lower rack 128. A mid-level spray-arm assembly 146 is located in an upper region of the wash chamber 106 and may be located in close proximity to upper rack 126. Additionally, an upper spray assembly 148 may be located above the upper rack 126.

The lower, mid-level, and upper spray-arm assemblies 140, 146, and 148 are part of a fluid circulation assembly 150 for circulating water and dishwasher fluid in the tub 104. The fluid circulation assembly 150 also includes a pump 152 positioned in a machinery compartment 158 located below the tub sump portion 144 (i.e., bottom wall) of the tub 104, as generally recognized in the art. Pump 152 receives fluid from sump 144 and provides a flow to an inlet 154 of a diverter 156. Diverter 156 can be used to selectively place pump 152 in fluid communication with spray assemblies 140, 146, or 148 by way of various outlet ports (not shown). Other spray assemblies and connection configurations may be used as well.

Each spray-arm assembly 140, 146 includes an arrangement of discharge ports or orifices for directing washing liquid received from diverter 156 onto dishes or other articles located in rack assemblies 126 and 128. The arrangement of the discharge ports in spray-arm assemblies 140, 146 provides a rotational force by virtue of washing fluid flowing through the discharge ports. The resultant rotation of the spray-arm assemblies 140, 146 and the operation of spray assembly 148 using fluid from diverter 156 provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

Each spray assembly may receive an independent stream of fluid, may be stationary, and/or may be configured to rotate in one or both directions. For example, a single spray arm may have multiple sets of discharge ports, each set receiving wash fluid from a different fluid conduit, and each set being configured to spray in opposite directions and impart opposite rotational forces on the spray arm. In order to avoid stalling the rotation of such a spray arm, wash fluid is typically only supplied to one of the sets of discharge ports at a time.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 160 may be positioned in a variety of locations throughout dishwasher 100. In the illustrated embodiment, the controller 160 may be located within a control panel area 162 of door 110 as shown in FIGS. 1 and 2. In such an embodiment, input/output ("I/O") signals may be routed between the control system and various operational components of dishwasher 100 along wiring harnesses that may be routed through the bottom 112 of door 110. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for racks 126, 128, different spray arm assemblies 140, 146, 148 may be used, and other differences may be applied as well.

Referring now generally to FIGS. 3 through 10, lower rack assembly 128 will be described in more detail. Although discussion below refers to lower rack assembly 128, one skilled in the art will appreciate that the features and configurations described may be used for other rack assemblies as well. For example, upper rack assembly 126 may have a similar construction and operate in a similar manner. Other variations and modifications of the exemplary embodiment described below are possible, and such variations are contemplated as within the scope of the present subject matter.

Figure 3:
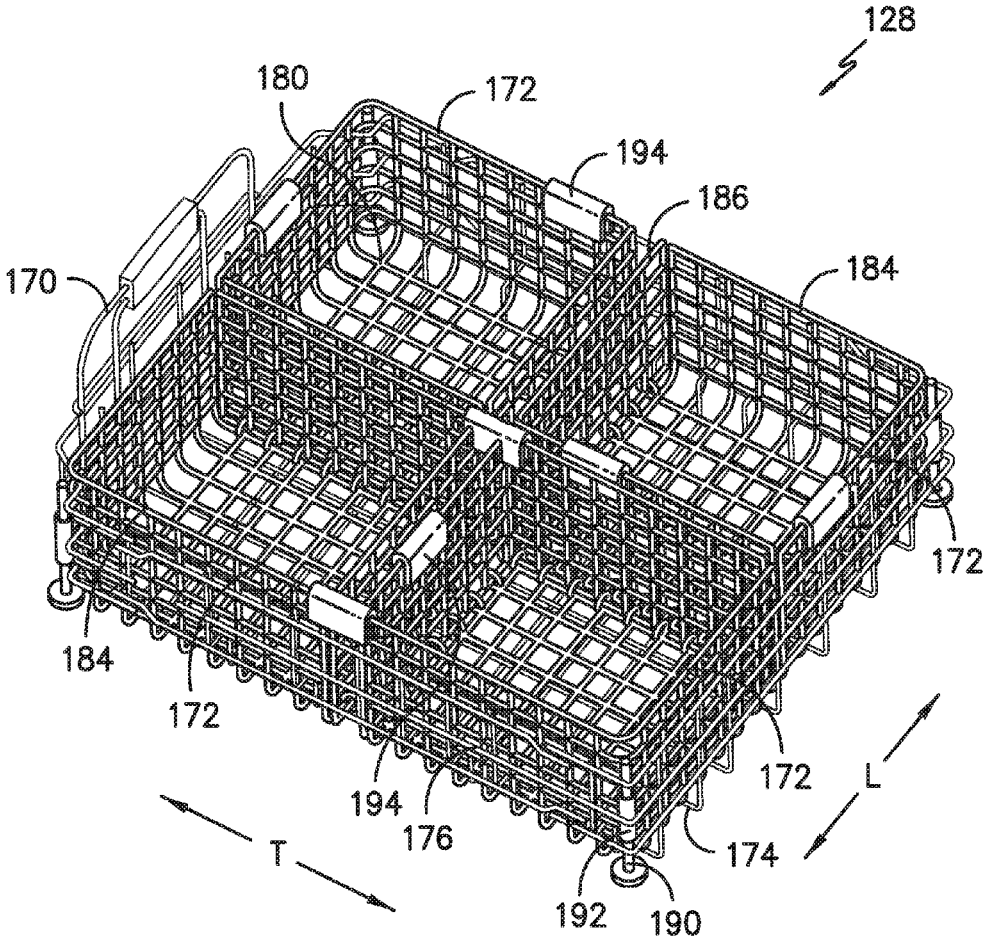
FIG. 3 is a perspective view of a dishwasher rack assembly containing a primary rack and four modular baskets according to an exemplary embodiment of the present subject matter.
Figure 4:
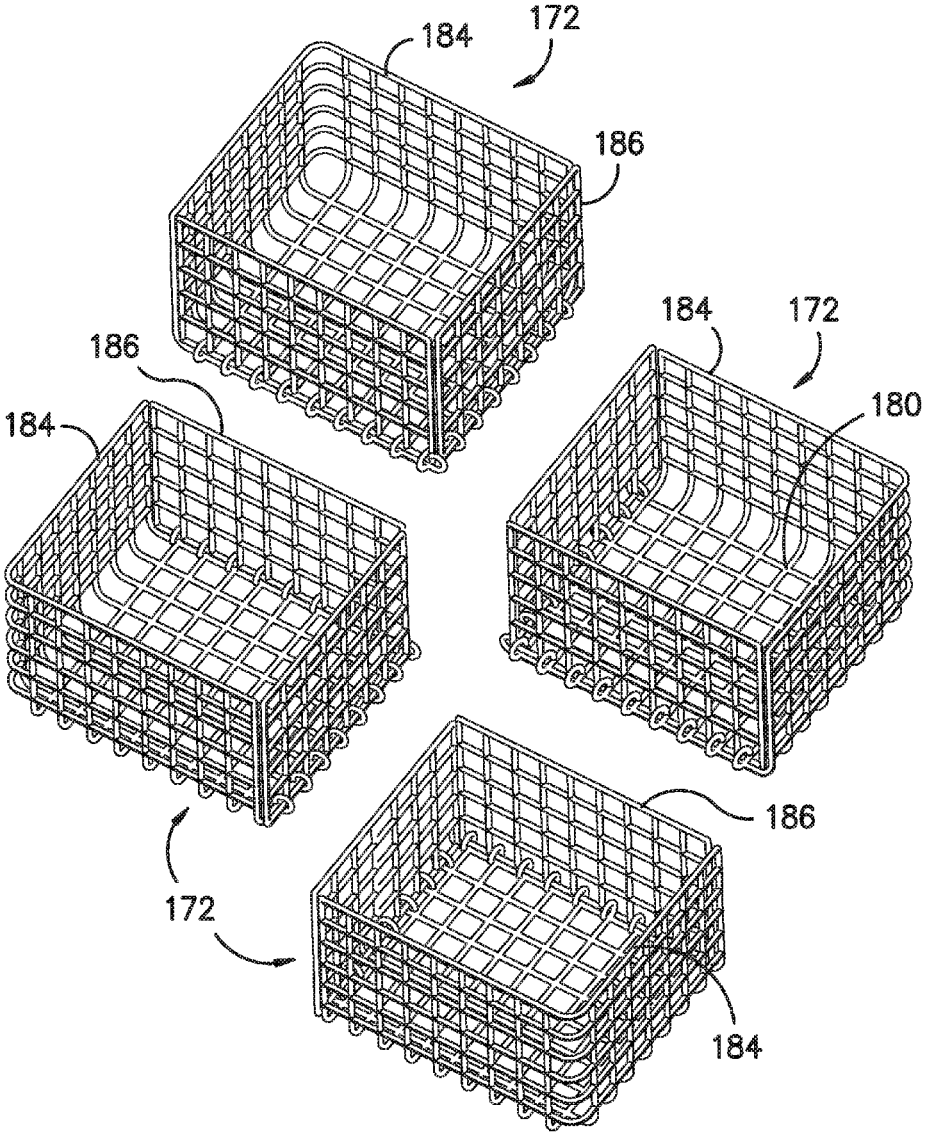
FIG. 4 is a perspective view of the modular baskets of the exemplary dishwasher rack assembly of FIG. 3.
Figure 5:
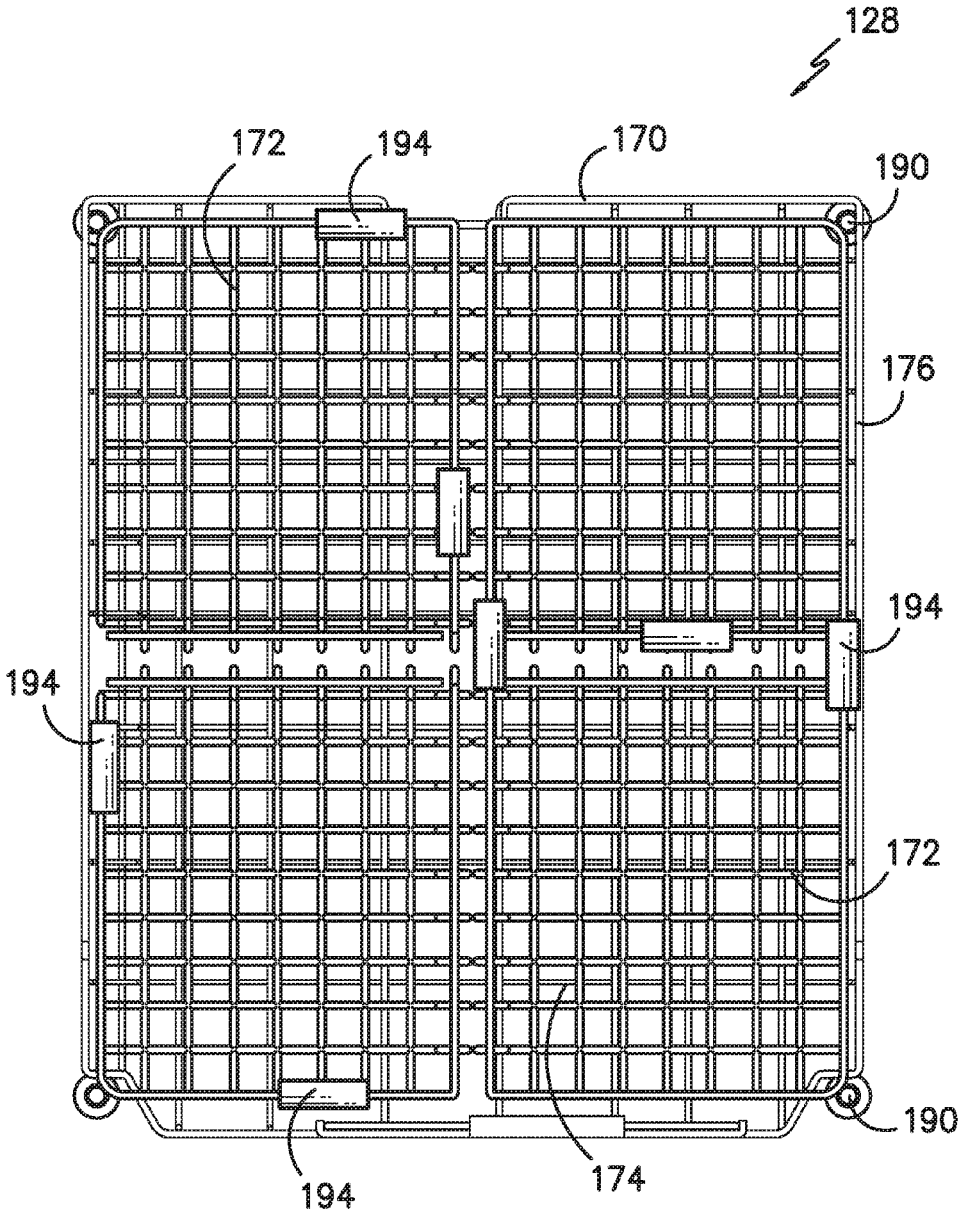
FIG. 5 is a top view of the exemplary dishwasher rack assembly of FIG. 3.
Figure 6:
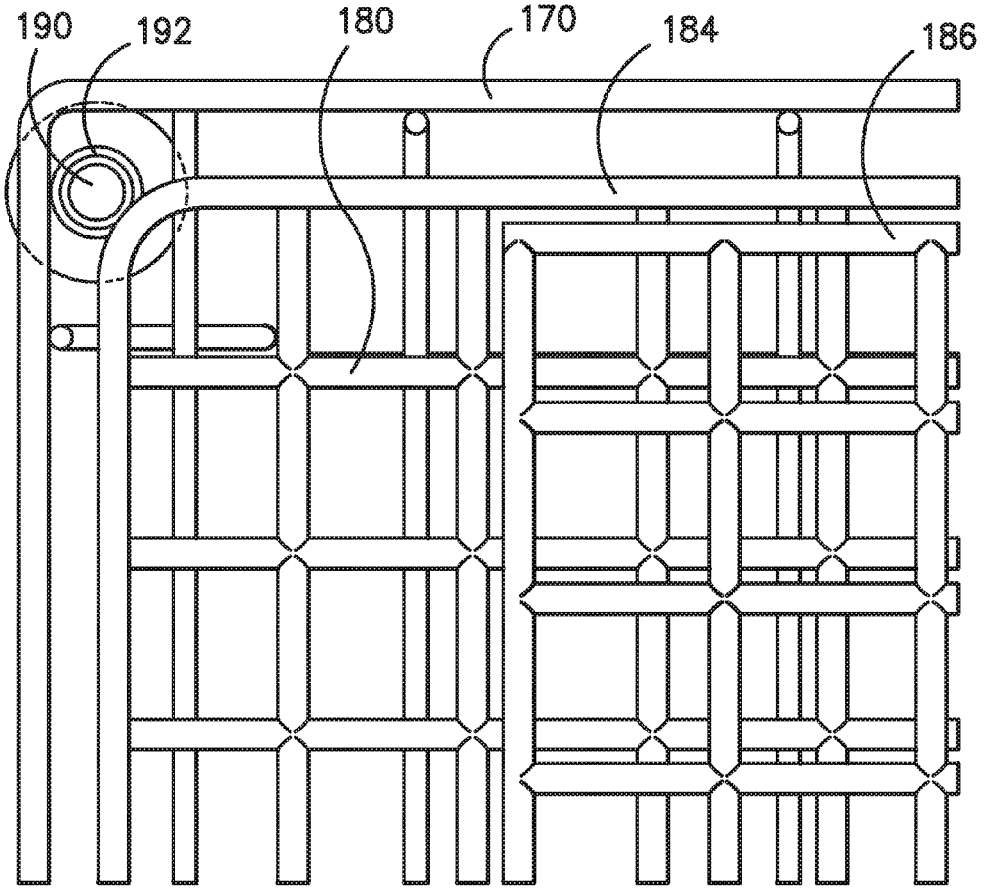
FIG. 6 is a close-up view of a modular basket mounted to the primary rack of the exemplary dishwasher rack assembly of FIG. 3.
Figure 7:
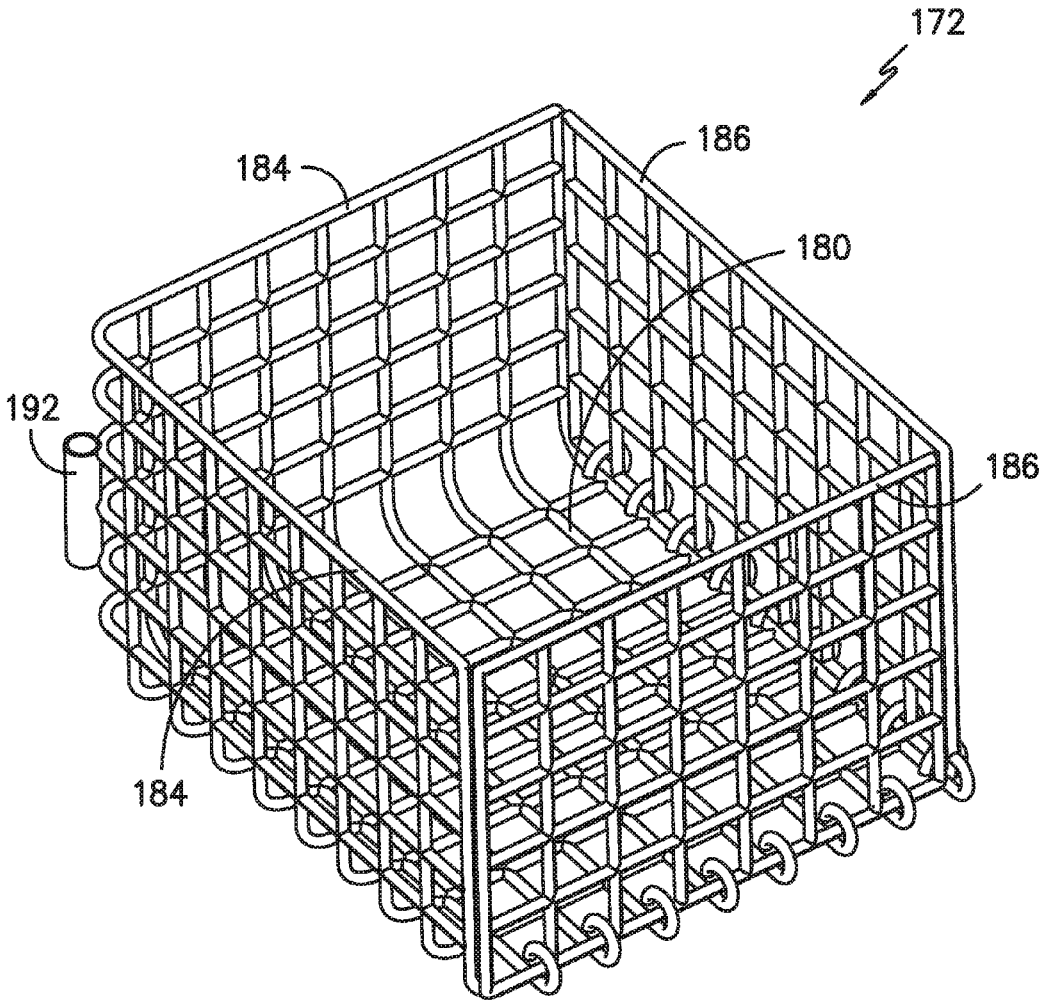
FIG. 7 is a perspective view of a modular basket of the exemplary dishwasher rack assembly of FIG. 3.
Figure 8:
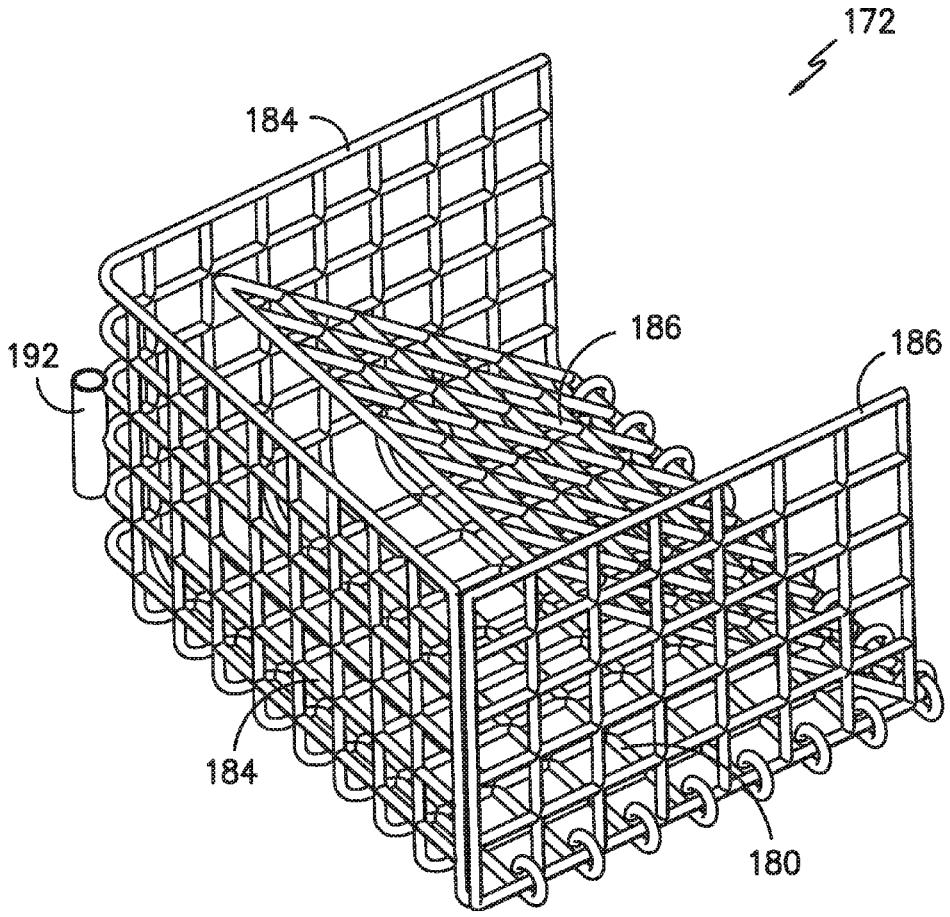
FIG. 8 is a perspective view of a modular basket of the exemplary dishwasher rack assembly of FIG. 3, with a collapsible sidewall being folded inward.
Figure 9:
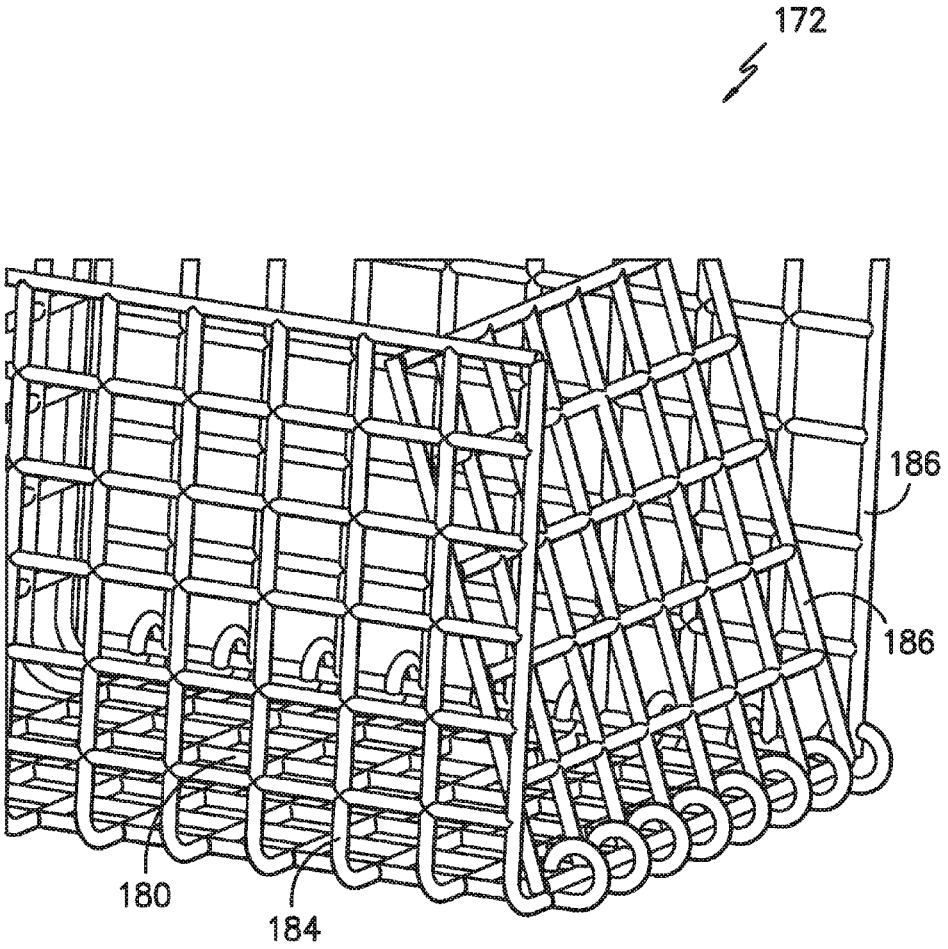
FIG. 9 is a perspective view of a modular basket of the exemplary dishwasher rack assembly of FIG. 3, with a collapsible sidewall being folded inward.
Figure 10:
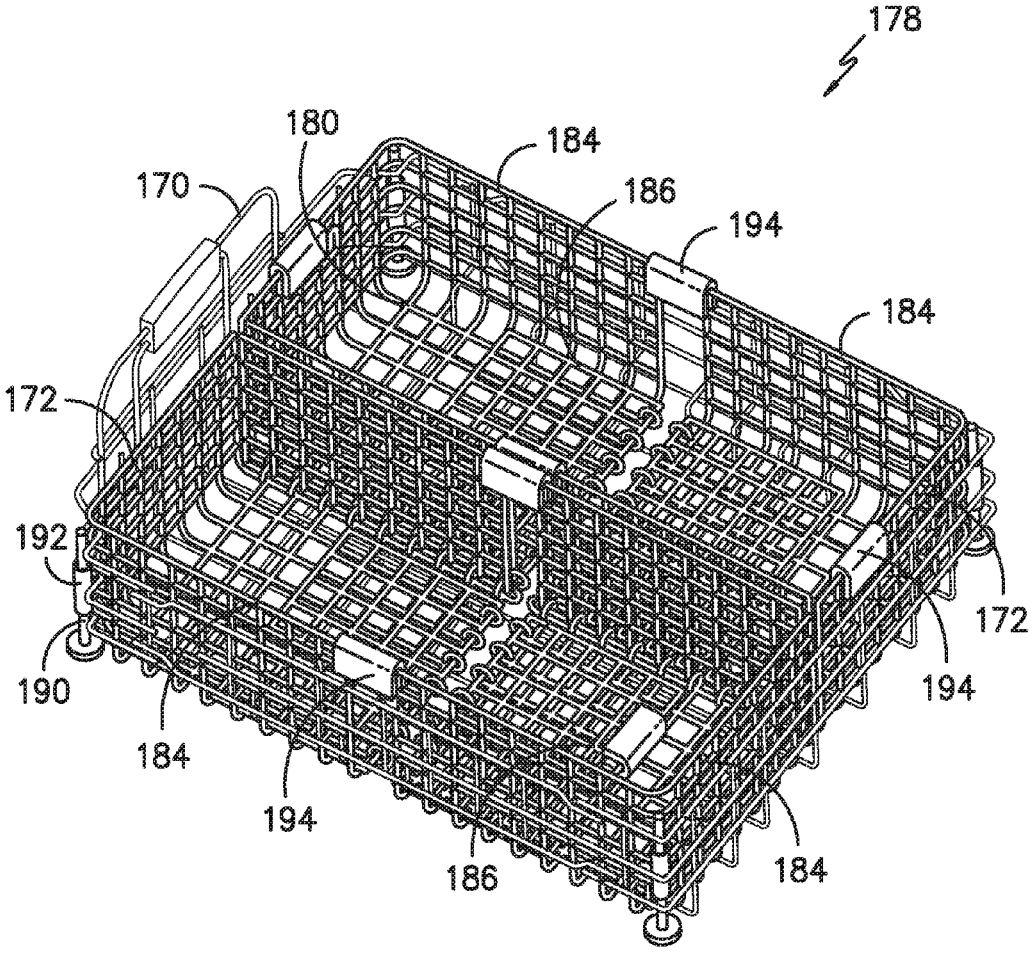
FIG. 10 is a perspective view of the exemplary dishwasher rack assembly of FIG. 3, with some of the collapsible walls being shown in the collapsed configuration.

FIG. 3 illustrates an exemplary embodiment of lower rack assembly 128. Lower rack assembly 128 includes a primary rack 170 and four modular baskets 172. Primary rack 170 has a bottom 174 and four fixed sidewalls 176 which define a rectangular compartment or cavity. Similarly, modular baskets 172 have a bottom 180 and four sides, which may be fixed, collapsible, or removable, as explained in detail below.

According to the illustrated embodiment, bottom 174 of primary rack 170 is a flat and rectangular. Similarly, modular baskets 172 also have a flat rectangular bottom 180. In this manner, primary rack 170 is configured to receive four modular baskets 172. One skilled in the art will appreciate that primary rack 170 may be constructed in any suitable size and shape. In addition, according to some embodiments, primary rack 170 and modular baskets 172 may have additional support features, such as tines or dividers, which are configured to support dishes, align modular baskets 172, divide the compartment, etc.

Each of primary rack 170 and modular baskets 172 may be fabricated from coated steel wire oriented to form a lattice structure. According to an alternative embodiment, any other suitably rigid material, e.g., plastic, may be used. The size and shape of the apertures in the lattice structure may vary depending on the needs of the application. For example, according to some embodiments, primary rack 170 may be configured only to receive modular baskets 172 and not for directly supporting dishes. Therefore, the lattice structure of primary rack 170 may have larger apertures than modular baskets 172, which directly receive dishes.

As illustrated, modular basket 172 has two fixed sidewalls 184 and two collapsible sidewalls 186. Fixed sidewalls 184 are adjacent to each other and are connected to form a corner of modular basket 172. In this manner, fixed sidewalls 184 remain upright relative to bottom 180. Collapsible sidewalls 186 are pivotally connected to bottom 180 of modular basket 172. More specifically, a bottom end of collapsible sidewall 186 is connected along an edge of bottom 180. As shown, the pivotal connection between bottom 180 and collapsible sidewall 186 is achieved by curling the lattice structure at an end of bottom 174 of primary rack 170 around a portion of the lattice structure of collapsible sidewall 186. In this manner, collapsible sidewall 186 is pivotally connected to the end of bottom 174 and is free to fold down to an orientation parallel to bottom 174. However, according to alternative embodiments, the pivotal connection may be achieved using any suitable hinge or pivot mechanism.

Although collapsible sidewalls 186 are shown as being one rigid, rectangular lattice structure, one skilled in the art will appreciate that collapsible sidewalls 186 could be constructed differently and remain within the scope of the present subject matter. For example, collapsible sidewalls 186 may be removable, may fold in multiple locations, may pivot along a different direction, or may be constructed as a solid panel instead of a lattice construction.

Primary rack 170 may further include one or more basket holding pins 190 and modular basket 172 may further include one or more basket holding sleeves 192. Pins 190 are configured to slidably receive sleeves 192 to assist in positioning, aligning, and mounting modular baskets 172 within primary rack 170. For example, according to the illustrated embodiment, primary rack 170 has a vertically oriented basket holding pin positioned at each corner. Similarly, each modular basket 172 has a vertically oriented basket holding sleeve 192 positioned on the exterior corner, for example, on the corner defined by two fixed sidewalls 184. In this manner, pins 190 and sleeves 192 may be used to ensure all four modular baskets 172 may be positioned in primary rack 170.

Although pins 190 and sleeves 192 are shown positioned in the four corners of primary rack 170, one skilled in the art will appreciate that this positioning is only exemplary and other configurations may be used. For example, according to alternative embodiments, pins 190 and sleeves 192 may be positioned at the center of primary rack 170. In addition, primary rack 170 may define other features for properly aligning modular baskets 172, e.g., alignment notches or ridges.

Modular baskets 172 may be selectively placed in or removed from primary rack 170 and configured to form a variety of lower rack assembly 128 configurations depending on the size of dishes that need to be cleaned. For example, collapsible sidewalls 186 may be collapsed into their respective modular baskets 172 along a lateral direction L to create one elongated compartment on one half of primary rack 170. In addition, or alternatively, collapsible walls 186 may be collapsed along a transverse direction T. One skilled in the art will appreciate that collapsible walls 186 may be positioned in any other suitable configuration depending on the needs of the application.

According to the illustrated embodiment, collapsible sidewalls 186 are free to rotate or collapse when not otherwise supported in the upright position. Accordingly, one or more clips 194 may be used to interconnect adjacent collapsible sidewalls 186 to fix them in the upright orientation. Clips 194 may be, for example, U-shaped resilient members that are snapped onto collapsible sidewalls. In this regard, clips 194 may be constructed from plastic, coated steel, or any other suitably rigid material.

The lower rack assembly 128 described above provides a convenient and versatile system including removable and configurable modular baskets 172 within primary rack 170, thereby simplifying loading, unloading, or prewashing dishes. Using this system, a user may selectively prewash very soiled articles before running a wash cycle. Thus, the total cycle time of the dishwasher appliance 100 may be reduced and energy and water savings may be achieved. Dishes may be loaded or unloaded at a height preferable to the user and the time required to load and unload dishes may be reduced. The small, lightweight modular baskets 172 improve ergonomics and user safety when using dishwasher appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwasher appliance defining a vertical, a lateral, and a transverse direction, the dishwasher appliance comprising:

a wash tub that defines a wash chamber;

a fluid circulation assembly for providing a fluid flow for cleaning articles placed within the wash chamber;

a primary rack slidably positioned within the wash chamber and configured for movement along the transverse direction between a first position where the primary rack is within the wash chamber and a second position where the primary rack is positioned outside the wash chamber, the primary rack comprising at least one basket holding pin;

one or more modular baskets removably placed in the primary rack for receipt of the articles for washing, each of the modular baskets comprising a bottom wall and a plurality of sidewalls, at least one of the plurality of sidewalls being collapsible; and at least one basket holding sleeve attached to at least one of the modular baskets, the basket holding sleeve configured to slide onto the basket holding pin to locate and secure the at least one modular basket within the primary rack.

2. The dishwasher appliance of claim 1, wherein the at least one basket holding pin is positioned at a corner of the primary rack.

3. The dishwasher appliance of claim 1, wherein the one or more modular baskets comprises four modular baskets.

4. The dishwasher appliance of claim 3, wherein the four modular baskets are rectangular and are configured to be removably positioned in four quadrants of the primary rack.

5. The dishwasher appliance of claim 4, wherein each of the four modular baskets comprises two sidewalls that are fixed together in an upright orientation and two sidewalls that are collapsible.

6. The dishwasher appliance of claim 5, wherein the two fixed sidewalls are adjacent each other and define a basket corner, and wherein a basket holding sleeve is mounted vertically to the corner.

7. The dishwasher appliance of claim 6, wherein the primary basket is rectangular and comprises four corners, each of the four corners having a vertically mounted basket holding pin, wherein each of the four modular baskets are removably mounted to the primary rack by sliding the basket holding sleeve onto the basket holding pin.

8. The dishwasher appliance of claim 1, further comprising one or more clips configured to couple two or more collapsible sidewalls of adjacent modular baskets, thereby fixing the collapsible sidewalls in the upright position.

9. The dishwasher appliance of claim 1, wherein each of the primary rack and the modular baskets are formed from coated steel wire oriented to form a lattice structure.

10. The dishwasher appliance of claim 9, wherein a collapsible sidewall is formed by curling the lattice structure at an end of the bottom sidewall around a portion of the lattice structure of the collapsible sidewall such that the collapsible sidewall is free to fold down to an orientation parallel to the bottom sidewall.

11. The dishwasher appliance of claim 1, wherein the primary rack defines support features for supporting the one or more modular baskets.

12. The dishwasher appliance of claim 11, wherein the support features comprise at least one of tines, dividers, notches, and ridges.

13. The dishwasher appliance of claim 1, wherein the primary rack defines primary rack apertures and the modular baskets define basket apertures, the primary rack apertures being larger than basket apertures.

* * * * *